United States Patent [19]

Hamilton et al.

[11] 4,214,438

[45] Jul. 29, 1980

[54] PYROTECHNIC COMPOSITION AND METHOD OF INFLATING AN INFLATABLE DEVICE

[75] Inventors: Brian K. Hamilton; Eugene F. Garner, both of Canyon Country; Charles Jackson, Newhall, all of Calif.

[73] Assignee: Allied Chemical Corporation, Morris Township, N.J.

[21] Appl. No.: 875,052

[22] Filed: Feb. 3, 1978

[51] Int. Cl.[2] ..... C06B 45/10

[52] U.S. Cl. ..... 60/205; 149/19.6; 149/35; 149/75; 149/82; 149/83; 149/108.8

[58] Field of Search ..... 149/19.6, 35, 82, 83, 149/108.8, 75

[56] References Cited

U.S. PATENT DOCUMENTS

| | | | |
|---|---|---|---|
| 3,055,781 | 9/1962 | Yamamoto | 149/19.6 |
| 3,532,359 | 10/1970 | Teague | 280/150 AB |
| 3,773,351 | 11/1973 | Catanzarite | 102/39 |
| 3,775,198 | 11/1973 | Hijikata | 149/85 |
| 3,785,674 | 1/1974 | Poole | 23/281 |
| 3,883,373 | 5/1975 | Sidebottom | 149/35 |
| 3,897,285 | 7/1975 | Hamilton et al. | 149/83 |
| 3,910,805 | 10/1975 | Catanzarite | 149/83 |
| 3,912,561 | 10/1975 | Doin et al. | 149/85 |
| 3,912,562 | 10/1975 | Garner | 149/82 |
| 3,947,300 | 3/1976 | Passauer et al. | 149/35 |
| 3,986,908 | 10/1976 | Grébert et al. | 149/83 |
| 3,996,079 | 12/1976 | DiValentin | 149/35 |
| 4,128,996 | 12/1978 | Garner et al. | 149/19.6 |

OTHER PUBLICATIONS

Hawley, "Condensed Chemical Dictionary", 8th Ed., pp. 33,36,37, Von Nostrand Reinhold Company (1971) New York.

*Primary Examiner*—Edward A. Miller
*Attorney, Agent, or Firm*—Roger H. Criss

[57] ABSTRACT

A pyrotechnic gas generating composition comprising a fuel and an oxidizer, the composition upon combustion generating a gas and a non-gaseous composition comprising a metallic salt or oxide, the metallic salt or oxide being a highly flowable liquid at the flame temperature of the composition upon combustion, and a viscosity modifier which is present in an amount to render the liquid substantially non-flowable at the flame temperature. Also disclosed is a method of inflating an inflatable device, such as a vehicle safety restraint, comprising the step of substantially completely inflating the device with the gaseous composition products of combustion of the pyrotechnic composition, whereby the metallic salt or oxide is substantially prevented from entering the device.

11 Claims, No Drawings

PYROTECHNIC COMPOSITION AND METHOD OF INFLATING AN INFLATABLE DEVICE

BACKGROUND OF THE INVENTION

1. Field of the Invention

This invention relates to pyrotechnic compositions and especially such compositions which are useful in inflating an inflatable device, such as a vehicle safety restraint, as well as to methods for so inflating the device.

2. Description of the Prior Art

Various pyrotechnic formulations have been proposed for generating a gas upon combustion in order to inflate an air bag or similar safety restraint in a vehicle so as to restrain movement of an occupant in the event of a sudden deceleration of the vehicle, such as caused by a collision. In order to be employed as a pyrotechnic gas generating composition for inflatable occupant restraints, several criteria must be met. The pyrotechnic must be capable of producing non-toxic, non-flammable and essentially smokeless gases over a wide variety of temperatures and other environmental conditions. The gases that are generated must be at a sufficiently low temperature so as not to destroy the restraint or injure the occupant. The pyrotechnic must also be safe to handle and must be capable of generating a substantial amount of gas within a very short period of time, e.g., less than about 100 milliseconds.

A wide variety of pyrotechnic compositions have been suggested for possible use for inflating vehicle occupant safety restraints. Some of these compositions produce non-gaseous metal salts or oxides along with the gas that is used to inflate the restraint. Since such salts or oxides are at a considerably higher temperature than the gaseous products, following combustion of the pyrotechnic composition, e.g., about 2000° F., it is necessary to retain the salts or oxides within the gas generator so as not to destroy the restraint or injure the occupant. These pyrotechnic compositions have not heretofore been considered as likely candidates for use in an occupant restraint device since elaborate filtering and/or cooling devices are required to retain the salts or oxides within the generator. This is despite the fact that such compositions produce a relatively low temperature, non-toxic gas within the requisite period of time. It would be desirable if such pyrotechnic compositions could be employed in an occupant restraint system without the need for elaborate filtering and cooling devices.

SUMMARY OF THE INVENTION

In accordance with this invention, there is provided a gas generating composition comprising a fuel and an oxidizer, said composition upon combustion generating a gas and a non-gaseous composition comprising a metallic salt or oxide, said metallic salt or oxide being a highly flowable liquid at the flame temperature of said composition upon combustion and a viscosity modifier which is present in an amount to render said liquid substantially non-flowable at said flame temperature.

Also in accordance with this invention, there is provided a method of inflating an inflatable device, such as a vehicle safety restraint, comprising the step of substantially completely inflating the device with the gaseous composition products of combustion of a composition comprising a fuel, an oxidizer and a viscosity modifier, the composition upon combustion also generating a non-gaseous composition comprising a metallic salt or oxide in the form of a highly flowable liquid at the flame temperature of the composition upon combustion, the viscosity modifier being present in an amount to render the liquid substantially non-flowable at the flame temperature, whereby the metallic salt or oxide is substantially prevented from entering said device.

It has been found that the presence of the viscosity modifier greatly increases the viscosity of the liquid metal salt or oxide. The resultant higher viscosity fluid can readily be retained in the gas generator by simple filtering devices. The viscosity modifier may be present as a component of the composition or may be generated from a precursor during combustion of the pyrotechnic composition.

DESCRIPTION OF THE PREFERRED EMBODIMENTS

The pyrotechnic gas generating compositions of this invention contain conventional fuel and oxidizer components. For example, the fuel may be an inorganic or an organic fuel, such as a highly oxygenated organic material. Examples of organic fuels include polyacetal resins, which may be the homopolymer or copolymers, polyvinyl acetate resins, polyesters, cellulose acetate, cellulose triacetate, polycarbonates, various forms of carbon and the like. Examples of inorganic fuels include metallic fuels such as aluminum, magnesium, iron and the like. Mixtures of various fuels may also be utilized. As oxidizers, any conventional oxidizing compound may be employed, such as metal or ammonium chlorates, perchlorates, chlorites, nitrates, nitrites and the like and mixtures thereof. Examples of such oxidizers include alkali metal oxidizers such as sodium chlorate, potassium chlorate, sodium perchlorate, potassium perchlorate, sodium chlorite, sodium nitrate, sodium nitrite, potassium nitrate, as well as ammonium chlorate, ammonium perchlorate, ammonium nitrate, and the like. Also, bromates or iodates may be employed instead of the corresponding chlorates (or perchlorates). Presently preferred as the fuel is a polyacetal resin and presently preferred as the oxidizer is sodium chlorate or potassium chlorate.

The fuel and oxidizer may be present in any conventional amount. For example, the composition may comprise from about 5 to 95 parts by weight fuel, preferably about 10 to 50 parts by weight fuel, and from about 5 to 95 parts by weight oxidizer, preferably about 50 to 90 parts by weight oxidizer.

The pyrotechnic compositions may further comprise a coolant. As coolants there may be employed calcium hydroxide, magnesium hydroxide, calcium carbonate, magnesium carbonate, nickel carbonate, alumina trihydrate ($Al_2O_3.3H_2O$) and the like and the like and mixtures thereof. Preferably, the composition contains a coolant and the composition comprises from about 5 to 40 weight percent fuel, more preferably about 10 to 25 weight percent fuel; from about 20 to 80 weight percent oxidizer, more preferably about 40 to 70 weight percent oxidizer; and from about 15 to 75 weight percent coolant, more preferably about 30 to 50 weight percent coolant. Presently preferred coolants are calcium hydroxide, magnesium hydroxide and alumina trihydrate.

Upon combustion of the pyrotechnic composition, a gas typically comprising water, oxygen and carbon dioxide, as well as a non-gaseous composition is produced. In the case of a polyacetal or similar fuel and a sodium or potassium chlorate oxidizer, the non-gaseous composition comprises a metallic salt or oxide. For example, with sodium chlorate as the oxidizer, the metallic salt that is produced comprises sodium chloride. At the flame temperature of the pyrotechnic composition, which may range up to 2000° F., for example, sodium chloride is in the form of a highly flowable liquid having a viscosity of 0.565 cps at about 2000 ° F. If such pyrotechnic composition were employed without the viscosity modifier of this invention, and without elaborate filtering and cooling devices in a pyrotechnic gas generator, the liquid would be passed along with the generated gases into the air bag or other inflatable restraint. In accordance with this invention, however, a viscosity modifier is provided in the gas generating composition. The viscosity modifier is a compound or composition which is either soluble in the metallic salt or oxide at the flame temperature of the composition or otherwise associates with the liquid to render the liquid thixotropic. The viscosity modifier increases the viscosity of the liquid to such an extent as to render the liquid substantially non-flowable at the flame temperature. For example, the viscosity of the liquid is increased to at least about 10,000 cps and preferably in the range of about 10,000 to 50,000 cps or higher whereby the liquid is retained in the gas generator.

A wide variety of viscosity modifiers may be employed in accordance with this invention. Such viscosity modifiers include calcium sulfate, glass, boric oxide, calcium fluoride and aluminum oxide and the like and mixtures thereof. Calcium sulfate and aluminum oxide are presently preferred. Such modifiers are present in suitably effective amounts, ranging from about 5 to about 70 percent by weight based on the weight of the pyrotechnic composition without such modifiers, and preferably from about 10 to 50 percent by weight. Instead of providing a viscosity modifier per se in the pyrotechnic composition, a viscosity modifier may be generated by the incorporation of various precursor compounds in the pyrotechnic compositions. For example, boric acid may be employed as the material which generates the viscosity modifier at the flame temperature of the composition. Upon combustion, the boric acid yields boric oxide which is soluble in the sodium chloride or other metallic salt or oxide and acts to increase the viscosity of the molten liquid. Examples of other precursors of viscosity modifiers which may be generated in situ include alumina trihydrate, which yields aluminum oxide as the viscosity modifier; a fluoropolymer, such as polytetrafluoroethylene, and calcium hydroxide which yields calcium fluoride; and calcium hydroxide, sulfur and oxygen (e.g., from the generated gas) which yields calcium sulfate. It should be noted that some of these precursors, such as alumina trihydrate, also act as coolants.

In addition to utilizing a pyrotechnic composition that yields a sodium chloride or other chloride or other halides as the molten liquid, other liquids that may be formed include metal carbonates and metal oxides and the like. Preferably, the metal is an alkali metal or an alkaline earth metal.

The viscosity modifiers utilized in the present invention are substantially non-flowable at the flame temperature of the composition. Therefore, the viscosity modifiers are chosen so as to remain as a solid at the flame temperature. Alternatively, the modifier may be a compound which although melts at the flame temperature of the composition has a very high viscosity at such flame temperature so as to permit the same to be incorporated and dissolved into or otherwise associated with the liquid metal salt or oxide and thereby greatly increase the viscosity of the latter.

As indicated above, the metal salt or oxide is in liquid form at the flame temperature of the pyrotechnic composition. Typical flame temperatures may be in the range of about 1500° to 3000° F. At such temperatures, the liquid is highly flowable; that is, it has a relatively low viscosity or is nearly inviscid. Accordingly, by the term "highly flowable" it is meant that the liquid has a viscosity of less than about 2000 cps and preferably less than about 1000 cps. By the presence of an effective amount of a viscosity modifier, the liquid is rendered substantially non-flowable. By "substantially non-flowable," it is meant that the viscosity of the liquid has increased to at least about 10,000 cps and preferably up to about 50,000 cps or more.

The pyrotechnic composition of this invention may be prepared by any suitable powder or pellet blending process known to those skilled in the art. In addition to the above enumerated components, the composition may optionally include a burn-rate modifier in the form of a pigment or the like. The preferred pigment is carbon black but other pigments may alternatively be employed such as graphite fibers, black iron oxide, red iron oxide, black copper oxide and organic dyes. The amount of pigment in the composition may vary, but preferably is in the range of about 0.01 to 3 weight percent of the composition, more preferably about 0.5 to 2.0 weight percent.

The compositions of this invention may be employed with any suitable gas generator apparatus for use in inflating a variety of inflatable devices, preferably vehicle occupant restraint devices, such as air bags. Since the otherwise liquid by-product is non-flowable, conventional solid filtering screens (e.g., metal screening) may be employed in such generators to prevent entry of the by-product into the inflatable restraint.

In order to further describe the present invention, the following non-limiting examples are given.

EXAMPLE 1

A pyrotechnic composition comprising approximately 8.5 wt.% of an acetal copolymer having a melt index of 9 (sold under the designation "Celcon"), 45.6 wt.% sodium chlorate, 22.3 wt.% alumina trihydrate, 20.8 wt.% calcium sulfate and 2.8 wt.% carbon black was intimately mixed by ball milling and pressed into pellets. One hundred ten grams of the pellets were loaded into a steering wheel inflator similar to that disclosed in U.S. Pat. No. 3,891,233 to Damon and fired into a 1 cubic foot tank. The viscosity of the liquid was such as to prevent any salts or oxides from being ejected into the tank. The gaseous output was calculated to be as follows: 2400° F. combustion temperature; an a volume basis: 55.1% $H_2O$, 8.4% $O_2$ and 36.6% $CO_2$.

EXAMPLE 2

A composition comprising 9.5 wt.% acetal copolymer, 51 wt.% sodium chlorate, 36.5 wt.% alumina trihydrate and 3 wt.% carbon black is prepared and fired as in Example 1. Similar results are noted.

It is to be understood that variations and modifications of the present invention may be made without departing from the scope thereof. It is also to be understood that the present invention is not to be limited by the specific embodiments disclosed herein but only in accordance with the appended claims when read in light of the foregoing specification.

I claim:

1. A pyrotechnic gas generating composition for generating a gas for inflation of an inflatable restraint, said composition consisting essentially of an organic fuel, an oxidizer and a viscosity modifier or precursor thereof, said organic fuel and said oxidizer upon combustion generating a gas and a non-gaseous constituent comprising a metallic salt or oxide, said metallic salt or oxide being in the form of a liquid having a viscosity of less than about 2,000 cps at the flame temperature of said composition, said viscosity modifier or precursor thereof being selected from the group consisting of alumina trihydrate, calcium sulfate, and mixtures thereof and being present in an amount effective to increase the viscosity of said liquid to at least about 10,000 cps.

2. The composition of claim 1 wherein said composition consists essentially of an organic fuel, an oxidizer and alumina trihydrate.

3. The composition of claim 2 further consisting essentially of a coolant.

4. The composition of claim 3 wherein said coolant is selected from the group consisting of calcium hydroxide and magnesium hydroxide and mixtures thereof.

5. The composition of claim 1 wherein said composition consists essentially of an organic fuel, an oxidizer and calcium sulfate.

6. The composition of claim 1 further consisting essentially of a coolant.

7. The composition of claim 1 wherein said organic fuel comprises a polyacetal resin.

8. A method of inflating an inflatable device comprising the step of substantially completely inflating the device with the gaseous composition products of combustion of a composition consisting essentially of an organic fuel, an oxidizer and a viscosity modifier or precursor thereof, said composition upon combustion also generating a non-gaseous composition comprising a metallic salt or oxide in the form of a fluid having a viscosity of less than about 2,000 cps at the flame temperature of said composition upon combustion, said viscosity modifier or precursor thereof being selected from the group consisting of alumina trihydrate, calcium sulfate, and mixtures thereof and being present in an amount effective to increase the viscosity of said liquid to at least about 10,000 cps, whereby said metallic salt or oxide is substantially prevented from entering said device.

9. The method of claim 8 wherein said composition consists essentially of an organic fuel, an oxidizer, and alumina trihydrate.

10. The method of claim 8 wherein said composition further comprises a coolant.

11. The method of claim 8 wherein said device is a vehicle safety restraint.

* * * * *

UNITED STATES PATENT AND TRADEMARK OFFICE

CERTIFICATE OF CORRECTION

PATENT NO. : 4,214,438

DATED : July 29, 1980

INVENTOR(S) : Brian K. Hamilton, Eugene F. Garner, and Charles Jackson

It is certified that error appears in the above-identified patent and that said Letters Patent are hereby corrected as shown below:

Column 6, Claim 10, Line 2, delete "comprises" and substitute therefor "consisting essentially of".

Signed and Sealed this

*Twenty-fourth* Day of *February 1981*

[SEAL]

*Attest:*

RENE D. TEGTMEYER

*Attesting Officer*

*Acting Commissioner of Patents and Trademarks*